United States Patent [19]

Lunderman et al.

[11] Patent Number: 4,840,288

[45] Date of Patent: Jun. 20, 1989

[54] COMPACT CASE WITH IRREVERSIBLE HINGE

[75] Inventors: William Lunderman, New York; David Seidler, Forest Hills, both of N.Y.

[73] Assignee: Revlon, Inc., New York, N.Y.

[21] Appl. No.: 239,167

[22] Filed: Aug. 31, 1988

[51] Int. Cl.[4] ..... B65D 85/68

[52] U.S. Cl. ..... 220/334; 206/235; 220/DIG. 26

[58] Field of Search ..... 206/235; 220/334, 335, 220/DIG. 26

[56] References Cited

U.S. PATENT DOCUMENTS

| | | |
|---|---|---|
| 1,688,042 | 10/1928 | Gaess . |
| 1,824,451 | 9/1931 | Soss . |
| 2,308,625 | 1/1943 | Rathbun . |
| 2,349,802 | 5/1944 | McKnight . |
| 2,393,568 | 1/1946 | Root . |
| 2,546,590 | 3/1951 | Ferrel . |
| 2,601,101 | 6/1952 | Derham . |
| 2,829,765 | 4/1958 | Burger . |
| 3,183,548 | 5/1965 | Speakman . |
| 3,317,078 | 5/1967 | Gordon . |
| 3,402,422 | 9/1968 | Baer . |
| 3,680,927 | 8/1972 | Neureuther . |
| 3,952,369 | 4/1976 | Erickson . |
| 4,306,601 | 12/1981 | Wallis et al. . |
| 4,331,168 | 5/1982 | Hatakeyama . |
| 4,372,331 | 2/1983 | Thompson . |
| 4,454,889 | 6/1984 | Contreras, Sr. . |
| 4,500,008 | 2/1985 | Cook . |
| 4,553,665 | 11/1985 | Weick et al. . |
| 4,588,074 | 5/1986 | Strong et al. . |
| 4,684,017 | 8/1987 | Watanabe et al. . |
| 4,693,392 | 9/1987 | Contreras, Sr. . |

FOREIGN PATENT DOCUMENTS

| | | |
|---|---|---|
| 29197 | 3/1956 | Fed. Rep. of Germany . |
| 576289 | 8/1924 | France . |
| 1279237 | 6/1972 | United Kingdom . |

*Primary Examiner*—Gerald A. Michalsky

[57] ABSTRACT

A compact case employs a 360°, double-pin hinge which pivotally connects a lid and a base of the compact case in such a manner that the lid can be tucked away behind the base for display and packaging purposes. Before the lid is closed for the first time, the hinge is permanently locked into a position which converts it into a 180°, single-pin hinge.

12 Claims, 4 Drawing Sheets

COMPACT CASE WITH IRREVERSIBLE HINGE

FIELD OF THE INVENTION

The present invention relates to compact cases, and, more particularly, to compact cases having a lid which is hingedly connected to a base in such a manner that the lid can be pivoted between an open position and a closed position.

BACKGROUND OF THE INVENTION

Compact cases and the like have been in existence for centuries. Traditionally, such cases have employed a lid or cover which is pivotally connected by a hinge or an equivalent mechanical mechanism to a base or body of the case.

In most instances, the lid can only be pivoted to a limited extent (i.e., along an arc having a length in a range of from about 90° to about 180°). Compact cases employing lids which cannot be pivoted a full 180° are usually packaged with their lids in a closed position. Because it is often desirable to expose the contents of a packaged compact case (so that a buyer can see the cosmetic product inside the case), the inability to package the case with its lid in an open position can present a problem.

Even for compact cases having lids adapted to pivot a full 180° (i.e., to a position in which the lid and the base are arranged generally side by side), a packaging problem may be encountered if such cases are packaged with their lids in an open position. This problem involves a need to provide a larger package due to the fact that the length of an opened compact case is approximately double that of a closed compact case.

U.S. Pat. No. 4,684,017 discloses a compact case including a case proper and a lid member which are connected to each other by a hinge adapted to permit the lid member to pivot through an arc of 360° relative to the case proper. When the lid is moved from its fully opened position to its fully closed position, an anchoring mechanism functions to temporarily convert the hinge from a 360° hinge to a 180° hinge. Thus, the anchoring mechanism is reversible. The reversibility of the hinge presents a number of potential problems. For instance, because of its reversibility, the hinge is prone to slip out of the position it assumes when functioning as a 180° hinge. As a result, it may be difficult to maintain the lid in an intermediate position in which the lid is arranged at an inclined angle relative to the case proper, since such an intermediate position requires that the hinge be functioning as a 180° hinge. The propensity of the hinge to slip out of the position it assumes when functioning as a 180° hinge also creates the possibility that the lid member may become ajar when in its closed position, thereby resulting in the possible spillage and or loss of the contents of the compact case.

SUMMARY OF THE INVENTION

The present invention overcomes the problems and disadvantages discussed above by providing a new and improved compact case of the type which includes a base, a lid and a hinge adapted to connect the lid to the base in such a manner that they can be arranged generally back to back, whereby the compact case may be packaged or displayed with the lid tucked away behind the base. More particularly, the hinge is provided with a link or a similar hinge member having a locking mechanism which functions to non-releasably lock the link or similar hinge member to the base of the compact case in response to the initial closing of the lid, whereby the link or similar hinge member is permanently maintained in a fixed (i.e., locked) position relative to the base after the lid has been moved to its closed position (i.e., a position in which the lid and the base are arranged generally face to face). Thus, after the lid is closed for the first time, the new and improved compact case functions like a conventional compact case (i.e., one in which the lid pivots not more than about 180° relative to the base).

In accordance with one exemplary embodiment of the present invention, the hinge employed by the new and improved compact case functions like a 360°, double-pin hinge until the link or similar hinge member is moved to its locked position. Once the link or similar hinge member is locked in place relative to the base, the hinge is automatically and irreversibly converted into a 180°, single-pin hinge.

BRIEF DESCRIPTION OF THE DRAWINGS

For a better understanding of the present invention, reference is made to the following detailed description of various exemplary embodiments considered in conjunction with the accompanying drawings, in which.

DESCRIPTION OF THE EXEMPLARY EMBODIMENTS

Figure 1:
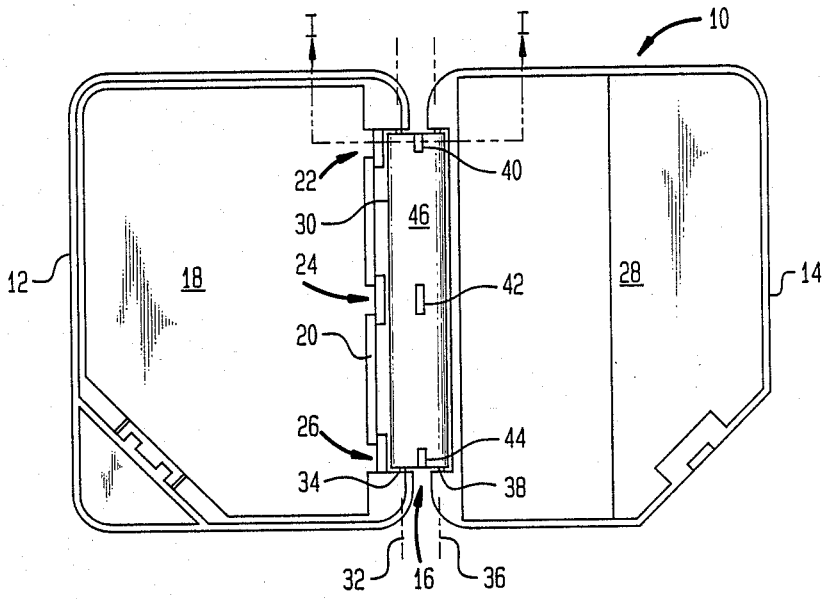
FIG. 1 is a top plan view of a compact case constructed in accordance with one exemplary embodiment of the present invention.
Figure 2:
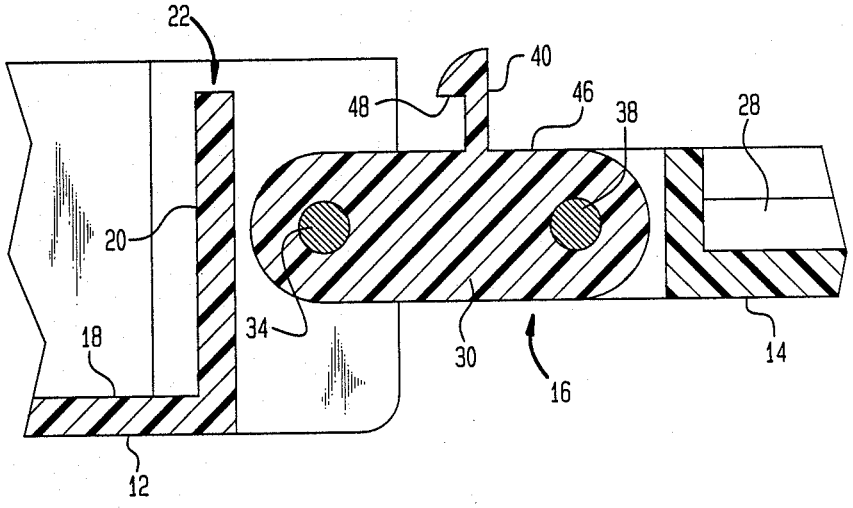
FIG. 2 is a partial cross-sectional view, taken along line I—I in FIG. 1 and looking in the direction of the arrows, of the compact case illustrated in FIG. 1.

Referring to FIGS. 1–6, a compact case 10 includes three main components: a base 12, a lid 14 and a hinge 16. Detailed descriptions of these components are set forth below, followed by a description of how they cooperate during the use of the compact case 10.

The base 12 has a cavity 18 which is sized and shaped so as to receive the usual inner lids, pads, cosmetic product, applicators, etc. A rear wall 20 of the base 12 is provided with notches or cutouts 22, 24, 26 in an upper edge thereof for a purpose to be described hereinafter.

The lid 14 is sized and shaped so as to completely cover the cavity 18 of the base 12. As is common practice, the lid 14 includes a mirror 28. Like the base 12, the lid 14 is preferably made from plastic.

The hinge 16 includes a link 30, which is also preferably made of plastic. The link 30 is pivotable relative to the base 12 about a pivot axis 32 defined by a hinge pin 34, which extends through the link 30 and into the base 12. Similarly, the link 30 is pivotable relative to the lid 14 about a pivot axis 36 defined by a hinge pin 38, which extends through the link 30 and into the lid 14. Rather than being provided as separate parts, the hinge pin 34 could be formed as an integral part of either the base 12 or the link 30, while the hinge pin 38 could be formed as an integral part of either the lid 14 or the link 30. As a further alternative arrangement, the link 30 could be pivotally connected to both the base 12 and the lid 14 by live hinges, whereby all three components (i.e., the base 12, the lid 14 and the hinge 16) would be molded or otherwise formed as a monolithic or single piece.

Figure 3:
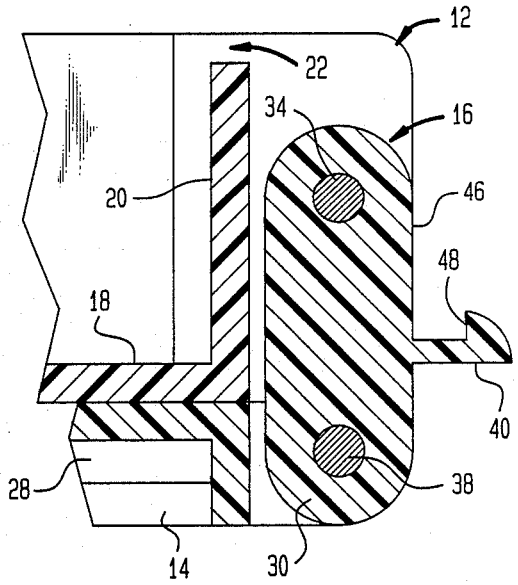
FIG. 3 is a partial cross-sectional view similar to the one illustrated in FIG. 2, except that the compact case is shown in a fully open position.
Figure 4:
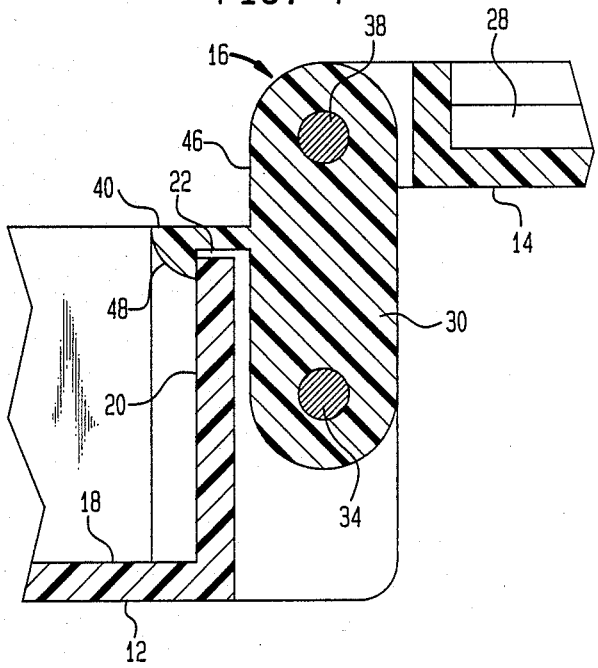
FIG. 4 is a partial cross-sectional view similar to those of FIGS. 2 and 3, except that the compact case is shown in a position assumed during the initial closing of the case.
Figure 5:
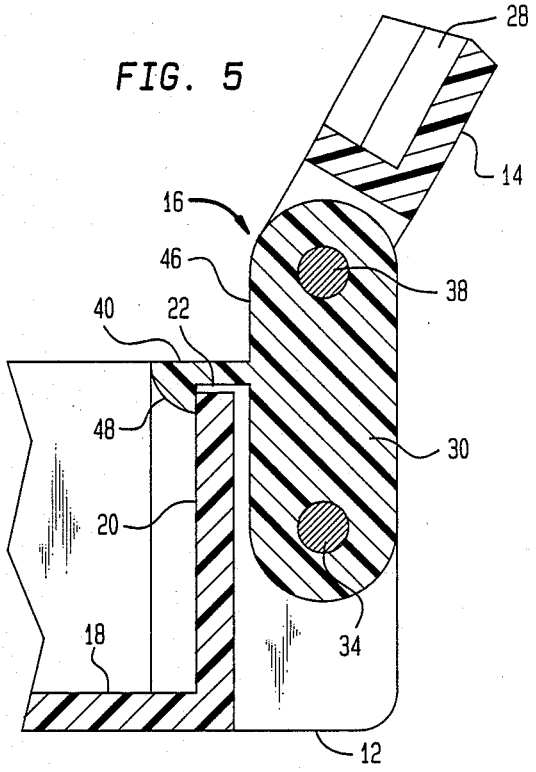
FIG. 5 is a partial cross-sectional view similar to those of FIGS. 2–4, except that the compact case is shown in another position assumed during the initial closing of the case.
Figure 6:
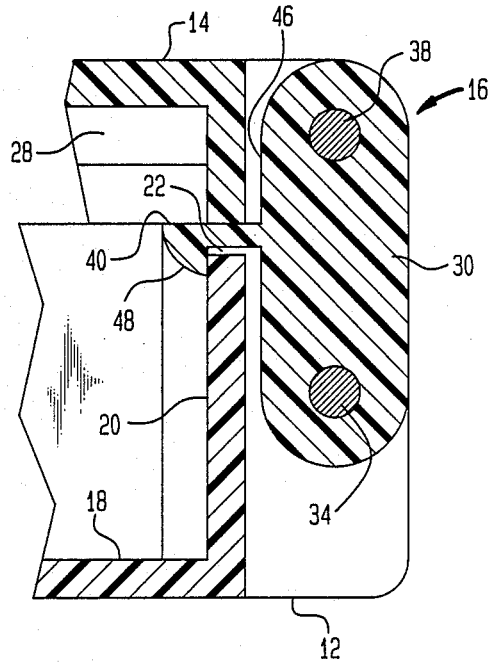
FIG. 6 is a partial cross-sectional view similar to those illustrated in FIGS. 2–5, except that the compact case is shown in a fully closed position.

Latches 40, 42, 44 project from a surface 46 of the link 30 which is remote from the base 12 when the link 30 is in its unlocked position (see FIG. 3) and which is proximate to the base 12 when the link 30 is in its locked position (see FIGS. 4–6). The latches 40, 42, 44 are positioned on the surface 46 of the link 30 such that they are in general alignment with the notches 22, 24, 26, respectively. Each of the latches 40, 42, 44 is provided with a hook 48 (see FIGS. 2–6) for a purpose to be described hereinafter.

Until the link 30 is moved to the locked position illustrated in FIGS. 4–6, the hinge 16 functions like a 360°, double-pin hinge to permit the lid 14 to be tucked away behind the base 12 (see FIG. 3). In this fully open position, which facilitates the displaying and packaging of the compact case 10, the base 12 and the lid 14 are arranged generally back to back.

After the compact case 10 is unpackaged and before it is closed for the first time, the link 30 is pivoted about the pivot axis 32 from the unlocked position illustrated in FIG. 3 to the locked position illustrated in FIGS. 4–6. As the link 30 is pivoted into its locked position, the latches 40, 42, 44 pass through the notches 24, 26, 28, respectively, until the hook 48 on each of the latches 40, 42, 44 automatically and non-releasably engages the rear wall 20 of the base 12. Accordingly, the link 30 is permanently maintained in its locked position. That is, the link 30 cannot be moved from its locked position without destroying the latches 40, 42, 44 and thereby rendering the compact case 10 unsuitable for its intended use.

Once the link 30 is in its locked position, the hinge 16 is converted into a conventional 180°, single-pin hinge to thereby permit the lid 14 to be pivoted between the positions illustrated in FIGS. 4–6. In the position illustrated in FIG. 6, the lid 14 is completely closed, whereby the base 12 and the lid 14 are arranged generally face to face.

Figure 7:
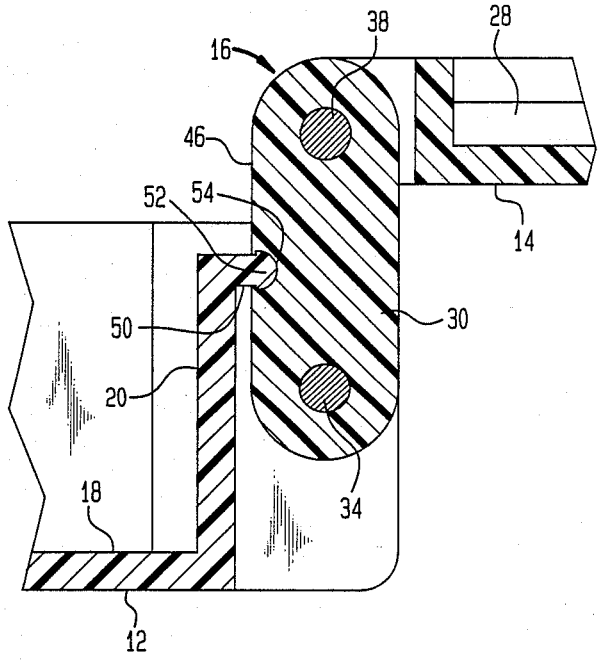
FIG. 7 is a partial cross-sectional view, which is similar to the partial cross-sectional view shown in FIG. 4, of a compact case constructed in accordance with another exemplary embodiment of the present invention.

With reference now to FIG. 7, an alternate locking arrangement is illustrated. In accordance with this alternate locking arrangement, the rear wall 20 of the base 12 is provided with at least one male member 50 which extends outwardly from the rear wall 20. Each male member 50 has a ball 52 which is sized and shaped so as to be frictionally and non-releasably received in a corresponding socket-like female member 54 formed in the surface 46 of the link 30. This embodiment, like the embodiment of FIGS. 1–6, functions to permanently maintain the link 30 in its locked position.

It will be understood that the embodiments described herein are merely exemplary and that a person skilled in the art may make many variations and modifications without departing from the spirit and scope of the invention. For instance, the number of latching members (whether they take on the form of those employed by the embodiment of FIGS. 1–6 or the form of those employed by the embodiment of FIG. 7) can be varied as desired. All such modifications and variations are intended to be included within the scope of the invention as defined in the appended claims.

What is claimed is:

1. A compact case, comprising a base; a lid; hinging means for hinging said lid to said base such that said lid is movable relative to said base between a first position in which said base and said lid are arranged generally back to back and a second position in which said base and said lid are arranged generally face to face, said hinging means including a hinge member pivotable relative to said base about a first pivot axis and pivotable relative to said lid about a second pivot axis, said first and second pivot axes being positioned relative to each other such that said hinge member is movable between an unlocked position, which said hinge member assumes when said lid is in said first position, and a locked position, which said hinge member assumes when said lid is in said second position; and locking means for automatically and non-releasably locking said hinge member in said locked position in response to the pivotal movement of said hinge member relative to said base as said hinge member is moved from said unlocked position to said locked position.

2. A compact case according to claim 1, wherein said second pivot axis is positioned on one side of said first pivot axis when said hinge member is in said unlocked position and wherein said second pivot axis is positioned on an opposite side of said first pivot axis when said hinge member is in said locked position.

3. A compact case according to claim 1, wherein said lid cannot be moved to said second position until said hinge member has been moved in said locked position.

4. A compact case according to claim 1, wherein said locking means includes first latching means provided on said base and second latching means provided on said hinge member, said first and second latching means cooperating with each other to lock said hinge member in said locked position.

5. A compact case according to claim 4, wherein said first latching means includes at least one cutout provided in an upper edge of said base and wherein said second latching means includes at least one projection provided on a surface of said hinge member which is remote from said base when said hinge member is in said unlocked position and which is proximate to said base when said hinge member is in said locked position, said at least one projection having engaging means for permanently engaging said base while said at least one projection extends through said at least one cutout.

6. A compact case according to claim 5, wherein said at least one cutout includes a plurality of cutouts and wherein said at least one projection includes a plurality of projections, each projection having engaging means for permanently engaging said base while said projection extends through a corresponding one of said cutouts.

7. A compact case according to claim 6, wherein said cutouts are provided in a rear wall of said base and wherein said engaging means of each projection includes a hook which is sized and shaped so as to pass through a corresponding one of said cutouts and then grip said rear wall.

8. A compact case according to claim 4, wherein said first latching means includes at least one male member extending outwardly from a rear wall of said base and wherein said second latching means includes at least one female member provided in a surface of said hinge member which is remote from said base when said hinge member is in said unlocked position and which is proximate to said base when said hinge member is in said locked position, said at least one female member being sized and shaped so as to frictionally engage said at least one male member when said hinge member is in said locked position.

9. A compact case according to claim 8, wherein said at least one male member includes a plurality of male members and wherein said at least one female member includes a plurality of female members, each female member being sized and shaped so as to frictionally and permanently engage a corresponding one of said male members when said hinge member is in said locked position.

10. A compact case according to claim 9, wherein each of said male members has a ball-shaped tip and wherein each of said female members has a socket which is sized and shaped so as to receive said ball-shaped tip of a corresponding one of said male members.

11. A compact case according to claim 1, wherein said first pivot axis is defined by a first hinge pin extending through said hinge member and into said base and wherein said second pivot axis is defined by a second hinge pin extending through said hinge member and into said lid.

12. A compact case according to claim 1, wherein said hinging means functions like a 360°, double-pin hinge until said hinge member is moved to said locked position and wherein said hinging means functions like a 180°, single-pin hinge after said hinge member is moved to said locked position.

* * * * *